US005095968A

United States Patent [19]

Didion

[11] Patent Number: 5,095,968

[45] Date of Patent: Mar. 17, 1992

[54] ROTARY MEDIA DRUM WITH COOLING COMPONENT

[75] Inventor: Charles J. Didion, St. Charles, Mo.

[73] Assignee: Didion Manufacturing Co., St. Peters, Mo.

[21] Appl. No.: 506,292

[22] Filed: Apr. 9, 1990

[51] Int. Cl.[5] ..... B22D 29/00

[52] U.S. Cl. ..... 164/404; 164/5; 241/65; 241/79.3; 241/DIG. 10

[58] Field of Search ..... 164/404, 5; 241/DIG. 10, 65, 79.3

[56] References Cited

U.S. PATENT DOCUMENTS

| | | | |
|---|---|---|---|
| 3,388,478 | 6/1968 | Vissers | 164/404 X |
| 3,958,623 | 5/1976 | Vissers et al. | 164/5 X |
| 3,998,262 | 12/1976 | Didion | 164/404 X |
| 4,674,691 | 6/1987 | Didion | 241/DIG. 10 X |

FOREIGN PATENT DOCUMENTS

| | | | |
|---|---|---|---|
| 0066931 | 12/1982 | European Pat. Off. | 164/404 |
| 2822333 | 12/1978 | Fed. Rep. of Germany | 164/404 |
| 2848195 | 9/1979 | Fed. Rep. of Germany | 164/404 |
| 58-159941 | 9/1983 | Japan | 164/5 |
| 7614086 | 6/1978 | Netherlands | 164/404 |
| 7707988 | 1/1979 | Netherlands | 164/5 |

*Primary Examiner*—J. Reed Batten, Jr.
*Attorney, Agent, or Firm*—Paul M. Denk

[57] ABSTRACT

A media drum incorporates an inner and outer cylinder, having a helical vane located generally intermediate thereof, with the media drum being supported upon a base, and its bearings, and motivated into rotation by a drive motor. The media drum integrally contains two parts, an entrance segment, and an exit segment. At the exit segment a cooling component, in the form of a liquid spray, is either directed into the drum, or into a jacket surrounding the exit segment of the drum, for cooling of the castings, media sand, abrasive members, to achieve a rapid cool down of these various components during usage of the apparatus. A reservoir is provided for collecting any excess liquid coolant, and a steam jacket surrounds the drum for collecting any generated steam for its removal.

5 Claims, 2 Drawing Sheets

ROTARY MEDIA DRUM WITH COOLING COMPONENT

BACKGROUND OF THE INVENTION

This invention relates to improvements embodied in a casting shake-out unit, and one wherein the reclamation of the green sand, and core and cling sand are separated, reconditioned, with the invention incorporating as its improvement the addition of a cooling means for use for temperature reduction of such sand/or casting as it traverses through its rotary drum.

There are a variety of apparatuses available for aiding in the separation and cleaning of a casting, as it is removed from its mold, principally for the purpose of eliminating that embedded core and cling sand that holds onto the casting after its processing, so as to eliminate the need for labor to spend excessive hours in cleaning the casting in preparation for its usage by the ultimate manufacturer. Such devices are readily shown in my earlier U.S. Pat. No. 3,998,262, which identifies and discloses a casting shake-out unit, and a method of its operation, which essentially incorporates a rotary drum, formed of a pair of cylinders, for use for facilitating the separation of the sane from its casting, during processing. Another patent obtained by me is U.S. Pat. No. 4,674,691, it is upon a dual sand reclaimer, once again, incorporating a rotary drum, wherein as the casting passes through the drum, it is subjected to tumbling, and exposure to abrasive members, that have a tendency to assist in removal of the cling sand, while additionally effecting a deburring of the casting, during its processing therein. In any event, both of these patented units, as shown in their respective patents, have worked highly successfully, and have been very commercially accepted, in providing to the foundries instruments that have saved many man hours of labor that were previously required in the processing of fresh castings. An additional feature of this current invention is the provision of improvements upon the attributes of these earlier shake-out and reclaimer units, by adding the further dimension of furnishing a cooling component that operates in conjunction with the rotary drum, for effecting a more immediate reduction in temperature of the casting, and especially its reclaimed sand, in preparation for its immediate reusage, while likewise providing for prompt removal and handling of the cleaned casting, as it departs from the drum.

SUMMARY OF THE INVENTION

This invention contemplates the formation of a sand reclaimer, and facilitation of the removal of sand from a fresh casting, through the usage of a rotary drum, of the type that is fabricated from a pair of cylinders, one being an outer cylinder, and the other being an inner and concentric cylinder, with the inner cylinder being generally perforated to provide for passage of mold sand, as separated from the casting, directly therethrough, and for its return to a source for collection, generally at one end of the drum, for its immediate reapplication in the casting of further components. In addition, the inner cylinder of the drum is designed for shifting of the casting from its entrance segment, to the exit segment, where the final sand is removed therefrom, while simultaneously applying a cooling medium, generally by means of a liquid spray, onto the casting, or perhaps just onto its removed sand, to achieve an immediate reduction in their temperature, for prompt processing. Essentially, the spray medium will apply water onto the casting and proximate sand, or onto any sand that is removed from the casting and collected proximate the exit end of the drum, so as to achieve its immediate temperature reduction, before the sand is transferred back to its point of collection, generally near the entrance segment of the media drum.

It is, therefore, the principal object of this invention to provide a rotary media drum for use as a shake-out in the treatment of delicate castings for separation of its residue mold sand therefrom, while simultaneously providing for a cooling of the casting, and/or its mold sand, for further processing.

A further object of this invention is to provide means for the removal and cooling of media sand, such as green, core and cling sand from the castings, and to effect its cooling in temperture to provide for its further shifting for collection of such processed sand for its immediate reusage.

Still another object of this invention is to provide a media drum with inherent cooling features that reduce the shot blast time necessary for cleaning of delicate castings up to approximately eighty percent.

Still another object of this invention is to provide a media drum that separates good green sand from core and cling sand, cools the same, for improved sand conditioning in preparation for its collection and reusage.

Still another object of this invention is to provide means for allowing the usage of a variety of media in the molding of castings and which can be effectively cooled, and collected, during processing of any casting within the media drum of this invention.

Yet another object of this invention is to provide a media drum that requires minimal installation cost because of simple foundation requirements, necessitates only low horse power, and incorporates a smooth drive system exhibiting a minimum of vibration for producing a cleaning of castings during their passage through the media drum.

Yet another object of this invention is to provide a media drum that is easy of maintenance, incorporates replaceable parts that can be promptly removed and replaced, while incorporating standard drive components to achieve its controlled rotation.

Yet another object of this invention is to utilize a fluid coolant in the form of a spray that is applied directly to the casting, and its sand, or the separated media sand alone, proximate the exit segment of the drum.

Still another object of this invention is to provide a media drum, while being significant of size and weight, is conveniently compacted together into a unified structure for ease of its assembly, shipment, and installation.

Still another object of this invention is to provide means for collection of cooled core sand, which is capable of being immediately reused.

Yet another object of this invention is to provide duct work or a jacket for venting of any generated steam within the cooling segment of a media drum so as to eliminate the dissemination of heat to any of the surounding environs.

These and other objects may become more apparent to those skilled in the art upon reviewing this summary of the invention, and upon undertaking a study of the description of its preferred embodiment, in view of the drawings.

DESCRIPTION OF THE PREFERRED EMBODIMENT

Figure 1:
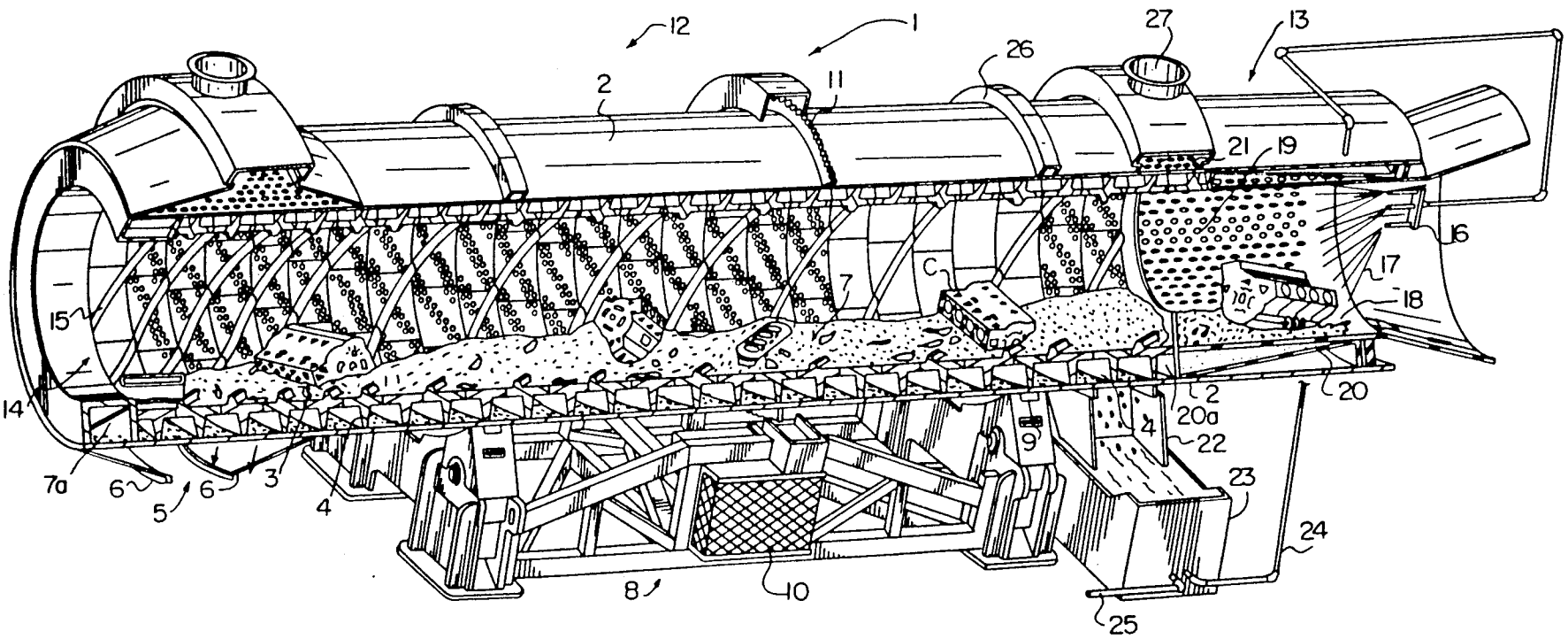
FIG. 1 is a sectionalized isometric view of the rotary drum of this invention disclosing its cooling component spraying a coolant within the exit end of its drum.

In referring to the drawings, and in particular FIG. 1, the rotary drum 1 of this invention is disclosed, and which incorporates an outer cylinder 2 having an inner perforated cylinder 3 arranged concentrically inwardly thereof, and, as can be seen, the inner cylinder is formed of segmented modular components that are sectionalized and interfitted together to form the liner of the inner cylinder. Between the inner and outer cylinders is provided a helical vane, as at 4, to provide for transfer of any separated mold sand falling through the inner cylinder to be urged back to its discharge end, as as 5, wherein it deposits into a conical chute 6 for dissent to a point of collection. Simultaneously, and as described in my U.S. Pat. No. 4,674,691, certain of the abrasive members, as shown at 7, may be returned back into the inner cylinder through openings located approximately at 7*a*, for further usage in abrading the core sand from the internal areas of any casting, as at C, passing through the rotary drum. As can be further noted, the rotary drum is mounted upon a base means 8, which includes a pair of bearing means 9, for support of the rotary drum during its rotation. In addition, a drive means, generally at 10, cooperates with a pinion or sprocket 11 for attaining a controlled rotation of the drum, during its application and usage.

The media drum of this invention is generally formed of two segments, one comprising an entrance segment, generally as shown at 12, while integrating with an exit segment 13. In the entrance segment 12, the castings are delivered to the rotary drum through its opening, as at 14, and are tumbled carefully as the shown rifling 15 shifts the castings along the rotary drum during its functioning. At this location, the castings are subject to the efforts of the abrasive elements 7, for removing not only core and cling sand from the casting, but likewise, the castings are delivered towards the exit segment 13. At the exit segment, the castings, and any remaining sand, is subject to the cooling spray of a spray head 16, which delivers a spray of cooling liquid, such as the water spray 17, onto the castings, and the remaining separated sand, in addition to the abrading elements, to provide for instantaneous cooling of these components. The exit segment 13 likewise includes an inner cylinder, as at 18, and which includes a plurality of apertures, as at 19, therethrough. While the castings are moved along the rotary drum, during its rotation, at this location, the remaining residue sand, plus any abrading elements, fall through these apertures or perforations 19, in their cooled condition, since they will have been subjected to the spray of the cooling medium 17, as explained. Intermediate the inner and outer cylinders 2 and 3, within this region of the exit segment of the media drum, is located a reversely inclined surface 20, where both the cooled sand, as separated from the casting, any abrading elements, and the residue of the cooling liquid, shift downwardly along the incline and towards the space between the perforated inner cylinder 3, and the outer cylinder 2, as noted. Openings are provided through the dam 20*a* to allow these elements to pass therethrough. At this location, the helical vanes 4 effectively shift the cleaned and cooled sand and abrading elements back towards the entrance end 14 of the media drum. But, the liquid coolant spray passes through perforations, as at 21, provided circumferentially around the outer cylinder, and is directed into a chute like arrangement 22 for collection within a reservoir 23. Surplus water from the reservoir is then repumped, by means of a pump means (not shown) through a flow line 24 and back towards the spray head 16, for a redelivery as a cooling medium back onto the castings and sand located within the exit segment 13 of the media drum. A further flow line 25 can deliver additional water to the reservoir 23, as it is in need of replenishment. In addition, a surrounding duct work or jacket 26 is provided around the outer cylinder 2, as can be noted, and overlies the outer cylinder perforations 21, which duct work is stationary and separate from the revolving drum, and incorporates an outlet vent 27 which may be in communication with an exhaust means (not shown) for attracting and removing any generated steam within the proximate vicinity of the media drum as such is created during deposit of the sprayed cooling liquid onto the hot castings and sand, at this vicintiy of the exit segment.

Figure 2:
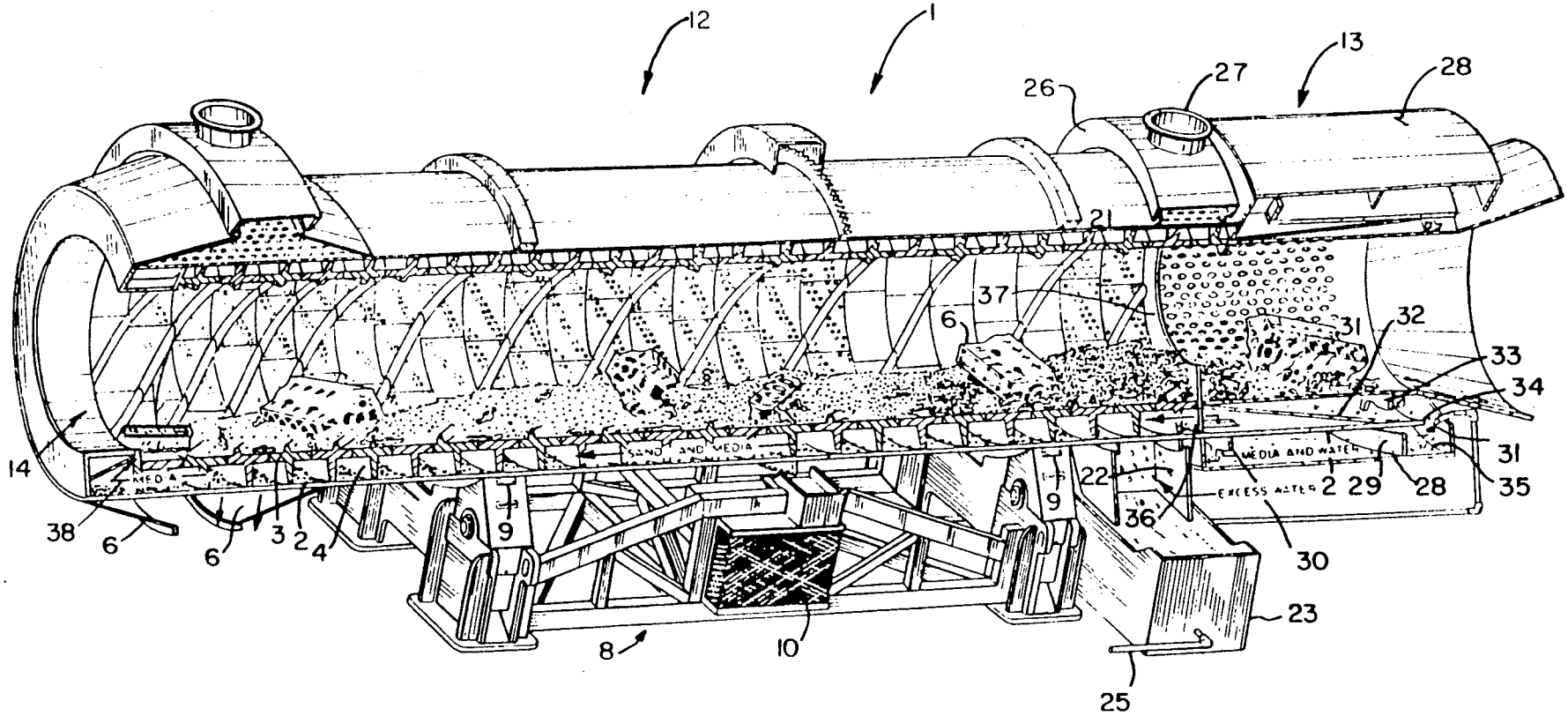
FIG. 2 is a sectionalized isometric view of a media drum disclosing its cooling component spraying a coolant into the core sand collection chamber of the drum.

FIG. 2 of this invention shows a media drum, almost identical to that which has been previously described with respect to FIG. 1, and for this reason, most of its operating components as integrated together into a functional apparatus are herein identified in a similar manner through the use of corresponding reference characters. But, in this particular instance, the exit segment 13 of the media drum 1 is fabricated having an outer jacket 28 surrounding it, and between this jacket 28 and the outer cylinder 2 there is provided a helical vane 29 that furnishes a shift of the cooling media and core sand and abrasive elements back towards the entrance segment 12 of the apparatus. At this location, the sand and water pass through a spacer ring 30 and through the series of openings 31, as provided within the outer cylinder 2, and are lifted by paddles (not shown), for passage into the space between the inner and outer cylinders 2 and 3, to come under the influence of the helical vanes 4. The vanes 4 shift the sand and abrading elements towards the entrance segment 14 of the drum, while the water is allowed to pass through the perforations 21 and directed by the chute 22 into the coolant reservoir 23.

It is to be noted that in this particular embodiment, the cooling means constitutes a spray head, as at 31*a*, which directly sprays its cooling liquid onto the sand and abrading elements collected at the proximate vicinity, after said sand drops from the inclined plate 32, passes through the spacer ring 33 and drops from the end 34 of the outer cylinder into the spacing 35 of the surrounding jacket 28, and come under the influence of the vane 29.

While the opening 31 may appear to be located only at the bottom of the outer cylinder 2, as depicted in this figure of the drawings, in actuality, there are a series of such openings 31 provided around the perimeter of this outer cylinder 2, at this location, and as the vane 29 delivers a quantity of media sand and water towards the spacer ring 30, and begins to compact a collection of such materials thereat, as the drum rotates, and the openings 31 having sand and water compacted there against, paddles (not shown) lift the sand and urge it through the said openings 31 to move it upwardly through rotation of the media drum 1, such components pass through the said openings 31, and then pass through the openings, one as shown at 36, provided within the dam ring 37, so that the accumulated water passes through the perforations 21, for delivery to the reservoir 23, while the sand, and any abrasive elements, that may be located thereat, are urged by the helical vane 4 towards the entrance end 14 of the drum. At this location, as was previously explained in my U.S. Pat. No. 4,674,691, the sand will drop from the chute 6, while the abrasive members are redirected through the openings 38 for resupply back into the interior of the inner cylinder 3, for reusage in aiding in the removal of any core and cling sand from the castings C, during their longitudinal transfer through the revolving media drum 1, as during its application.

In any event, it can be seen that the media drum of this invention has added dimension of incorporating a cooling medium within its operations, either by providing for a direct spray of liquid, such as water, into the exit segment 13 of the drum, and onto its castings and abrasive members and sand, to cool all of them in combination, such as shown in FIG. 1 of the drawings, or the cooling medium may be sprayed only onto the sand, and any abrasive members, as they are deposited into the space 35, of the jacket 28 connected within the structure of the exit segment 13 of the said media drum. These are examples as to how the cooling medium may be added into the structure of this invention.

In usage of the media drum of this invention, the castings to be cleaned, with its sand clinging thereto, are introduced by means of a vibratory feeder into the intake or entrance opening of the sand casting separator/media drum. Green sand is immediately separated from the castings as the material is tumbled through the entrance segment of the media drum, with the green sand immediately sifting through the perforated inner liner or inner cylinder of the drum, and is flighted by means of the helical vanes to the intake end of the drum, for discharge through its chute. The castings and any residue clinging and core sand are further moved by means of the rifling through the media drum, which accelerates their shift through the drum, while at the same time further core sand is separated from the castings through the functioning of any abrasive members located therein, which act as a positive means to achieve such sand removal. The core butts and burrs are reduced, if not eliminated, by means of the attrition of the castings upon the inner cylinder of the media drum, and through its exposure to any abrasive members contained therein. Simultaneously, the castings are scrubbed through this type of cleaning action. The lining configuration of the media drum, and more specifically its inner cylinder, is designed to process large and heavy castings, or even small and delicate type of castings. The amount of retention time and cleaning of the castings is determined by the lining configuration and the height of the dam ring 37 that separates the entrance segment from the exit segment of this media drum. At the dam ring all of the core and the inclusion sand is separated from the castings, the castings and abrasive medium, in addition to any additional core sand as separated from the castings pass over the said dam ring, where the media sand and elements are now totally separated from the castings, the media falls back through the larger perforations, with any residue core sand, are conveyed back towards the entrance of the media drum, through the action of the intermediate helical vane. At the entrance end, the outer cylinder at the intake end functions to screen any abrasive members from the core sand, to achieve a recirculation of said abrasive members, and a removal of any excess core sand, in the manner as previously described, through its discharge chute. At the exit end, the cooling means in the form of the shown sprayhead deposits its spray of liquid, such as water, either directly interiorly of the inner cylinder, for spraying onto the castings and any residue core sand in addition to any abrasive members located thereat. Or, the cooling means can be sprayed into the jacket compartment at the exit end of the media drum, for cooling any sand and abrasive media located thereat, as previously shown in FIG. 2. Any excess water can be collected, within the reservoir, and any generated steam can be vented by means of its exhausting through its steam duct or jacket.

Variations or modifications to the subject matter of this invention may be considered by those skilled in the art upon reviewing the subject matter of this disclosure. Such variations or modifications, if within the spirit of this invention, are intended to be emcompassed within the scope of any claims to patent protection issuing upon this development. The description of the preferred embodiment set forth herein is done so for illustrative purposes only.

Having thus described the invention what s claimed and desired to be secured by Letters Patent is:

1. A rotary media drum for use in separating surface disposed core sand from its castings as removed from their molds and then effecting a cooling of the same, comprising, a rotary drum, a base means supporting the drum for a slow speed of rotation, bearing means provided upon the base means and supporting the drum during said rotation, drive means provided with the base means and furnishing the drum with its slow speed of rotation, said rotary drum comprising a pair of cylinders, one cylinder being an outer cylinder, the other cylinder being an inner and concentric cylinder with the outer cylinder, there being a spacing provided between the two said cylinders, a series of helically arranged vanes provided at least partially between the two arranged cylinders and within the spacing, said drum being formed of at least two segments, the first segment being an entrance segment provided for the entrance of the castings therein and effecting removal of the surface disposed mold sand therefrom during tumbling of the castings, the entrance segment of the inner cylinder having means provided therewith for moving the castings longitudinally therealong, the entrance segment of the inner cylinder having openings provided therethrough for passage of the removed sand into the spacing, said vanes thereat providing for movement of the sand for disposition, the second segment of the inner cylinder being an exit segment and having a series of openings therethrough and providing for the separation of any residue loosened sand from the castings and with the sand passing into the spacing between the two said cylinders while said castings are discharged from the drum, means provided between the cylinders within the second segment for moving the separated sand towards the spacing between the cylinders within the exit segment of said cylinders for a return to the entrance segment of the inner cylinder for its removal, cooling means operatively associated with the exit segment and effecting a cooling of removed sand therat, said cooling means comprising a spray head operatively associated with the exit segment of said cylinder, said exit segment of said cylinder including a collection jacket for reception of the loosened sand as separated from the castings, and said cooling means comprising said spray head for directing a coolant into the said collection jacket to effect a temperature reduction of the separated sand deposited within said jacket, and a fluid directing means and reservoir disposed beneath the rotary drum for collection of any fluid from the drum after its spray upon the sand for cooling.

2. The invention of claim 1 and wherein the inner cylinder within the entrance segment being sectionalized.

3. The invention of claim 1 and wherein means for effecting a disposal of the loosened and returned sand from the drum back to the entrance segment, said means comprising a discharge chute provided at the entrance segment for removal of the returned sand.

4. The invention of claim 1 and including means between the cylinders within the exit segment for moving of the sand towards the entrance segment, said means comprising an inclined member sloped to direct the sand towards the spacing containing the helical vanes between the cylinders within the entrance segment.

5. The invention of claim 1 and wherein said jacket provided around the drum at the vicinity of the fluid reservoir also provided for evacuating any steam generated within the drum during spraying of a cooling fluid within said collection jacket.

* * * * *